US008485316B2

(12) United States Patent
Vestal et al.

(10) Patent No.: US 8,485,316 B2
(45) Date of Patent: Jul. 16, 2013

(54) COLLAPSIBLE SAFE LADDER

(75) Inventors: Floyd LaVern Vestal, Independence, KS (US); Jeffrey A. Green, Bartlesville, OK (US)

(73) Assignee: Lock N Climb, LLC, Bartlesville, OK (US)

( * ) Notice: Subject to any disclaimer, the term of this patent is extended or adjusted under 35 U.S.C. 154(b) by 277 days.

(21) Appl. No.: 12/418,035

(22) Filed: Apr. 3, 2009

(65) Prior Publication Data

US 2010/0252364 A1 Oct. 7, 2010

(51) Int. Cl.
*E06C 1/14* (2006.01)
*E06C 1/383* (2006.01)
*E06C 7/18* (2006.01)

(52) U.S. Cl.
USPC ..... 182/107; 182/172

(58) Field of Classification Search
USPC ..... 182/107, 172, 204, 201, 108, 165, 182/168, 171
See application file for complete search history.

(56) References Cited

U.S. PATENT DOCUMENTS

| | | | | |
|---|---|---|---|---|
| 202,426 | A | 4/1878 | Evans | |
| 281,977 | A | 7/1886 | Coons | |
| 475,935 | A * | 5/1892 | Crews | 182/168 |
| 515,783 | A | 3/1894 | Moore | |
| 886,737 | A | 5/1908 | Taylor | |
| 1,385,319 | A * | 7/1921 | Enke | 182/172 |
| 1,811,722 | A | 6/1931 | Kimberlin | |
| 1,812,119 | A * | 6/1931 | Ruse | 182/180.3 |
| 2,007,057 | A | 7/1935 | McNeal | |
| 2,471,110 | A | 5/1949 | Jenkins | |
| 2,584,197 | A | 2/1952 | Garner | |
| 2,887,260 | A | 5/1959 | McKinnie | |
| 2,934,163 | A * | 4/1960 | Ladewski | 182/214 |
| 3,288,248 | A | 11/1966 | Gurian et al. | |
| 3,508,628 | A | 4/1970 | Conrad | |

(Continued)

FOREIGN PATENT DOCUMENTS

| | | | |
|---|---|---|---|
| GB | 2099060 | A | 12/1982 |
| GB | 2146688 | A * | 4/1985 |
| GB | 2166793 | A * | 5/1986 |
| GB | 2218451 | A * | 11/1989 |

OTHER PUBLICATIONS

PCT/US10/29606—International Bureau preliminary report on patentability dated Oct. 13, 2011.
PCT/US10/29606—ISR dated May 21, 2010.

(Continued)

*Primary Examiner* — Alvin Chin Shue
*Assistant Examiner* — Jamie F Cardenas-Garcia
(74) *Attorney, Agent, or Firm* — Michael Stanley Tomsa; Katten Muchin Rosenman LLP

(57) ABSTRACT

A ladder system is disclosed which allows for stabilizing a ladder, on multiple surfaces, without the need for a second person or a great deal of setup time. The collapsible ladder system includes a larger ladder section and a smaller ladder strut section that is pivotally connected at a point which is at or below the midpoint of the larger ladder section. The larger ladder section and smaller ladder strut section are connected by a rigid adjustable linkage, or spreader, at a point that is below the pivotable connection. The ladder further includes a means for stability on a variety of surfaces. At the ground contacting point, the point where the ladder side rail ends and the ground meet, there are adjustable gripping feet, which can be independently or in combination vertically or angularly adjusted for maximum stability.

19 Claims, 8 Drawing Sheets

U.S. PATENT DOCUMENTS

| | | | | | |
|---|---|---|---|---|---|
| 3,933,221 | A | * | 1/1976 | Sorenson | 182/172 |
| 4,069,893 | A | * | 1/1978 | Blackstone | 182/200 |
| 4,147,231 | A | * | 4/1979 | Chantler et al. | 182/172 |
| 4,207,886 | A | * | 6/1980 | Sorenson | 182/172 |
| 4,244,446 | A | * | 1/1981 | Mair | 182/172 |
| 4,421,206 | A | * | 12/1983 | Kummerlin | 182/156 |
| 4,483,415 | A | * | 11/1984 | Disston et al. | 182/22 |
| 4,520,896 | A | * | 6/1985 | Disston et al. | 182/22 |
| 4,565,262 | A | * | 1/1986 | Hawkins | 182/116 |
| 4,669,576 | A | | 6/1987 | Jones | |
| 4,723,629 | A | * | 2/1988 | Vanden Hoek et al. | 182/107 |
| 4,798,262 | A | * | 1/1989 | Margolies | 182/106 |
| 4,899,849 | A | * | 2/1990 | Levi et al. | 182/172 |
| 4,949,809 | A | * | 8/1990 | Levi et al. | 182/172 |
| 5,033,584 | A | | 7/1991 | Battle | |
| 5,086,876 | A | * | 2/1992 | Severson | 182/172 |
| 5,165,501 | A | * | 11/1992 | Donahey | 182/214 |
| 5,267,631 | A | * | 12/1993 | Mendel | 182/107 |
| 5,341,899 | A | | 8/1994 | Casamento | |
| 5,522,473 | A | * | 6/1996 | Moselsky | 182/204 |
| 5,551,529 | A | * | 9/1996 | Molitor | 182/204 |
| 5,590,739 | A | * | 1/1997 | High et al. | 182/169 |
| 6,382,353 | B2 | * | 5/2002 | Laug | 182/107 |
| 6,450,290 | B1 | * | 9/2002 | Spak | 182/165 |
| 6,533,071 | B1 | * | 3/2003 | Smith | 182/172 |
| 6,948,591 | B2 | * | 9/2005 | Scott et al. | 182/201 |
| 7,163,084 | B1 | * | 1/2007 | Blehm | 182/172 |
| 7,293,630 | B1 | * | 11/2007 | Trebec | 182/172 |
| D565,745 | S | * | 4/2008 | Meyers et al. | D25/65 |
| 7,487,859 | B2 | * | 2/2009 | Wang | 182/21 |
| 2001/0015303 | A1 | * | 8/2001 | Laug | 182/107 |
| 2006/0272899 | A1 | * | 12/2006 | Chang | 182/201 |
| 2007/0181370 | A1 | * | 8/2007 | Kemp-Banks | 182/204 |
| 2007/0261918 | A1 | * | 11/2007 | Trebec | 182/172 |
| 2008/0000720 | A1 | * | 1/2008 | Porch et al. | 182/107 |
| 2009/0045013 | A1 | * | 2/2009 | McMurray | 182/172 |
| 2009/0107765 | A1 | * | 4/2009 | Germond | 182/172 |
| 2010/0147623 | A1 | * | 6/2010 | Pocos | 182/107 |
| 2010/0236866 | A1 | * | 9/2010 | Huang | 182/159 |
| 2010/0300805 | A1 | * | 12/2010 | Moss et al. | 182/18 |
| 2011/0067954 | A1 | * | 3/2011 | Deal | 182/107 |

OTHER PUBLICATIONS

International Search Report and Opinion for International Application No. PCT/US2011/050882, with a mailing date of Jan. 5, 2012.

* cited by examiner

COLLAPSIBLE SAFE LADDER

BACKGROUND

Ladders have the problem that when in use, they are generally unstable. This lack of stability will often lead to injury or even death. Indeed, injuries related to ladder use are a leading problem in construction, repair and other industries. Until now, the most common way to remedy an unstable ladder is to require a second person to be positioned at the base of the ladder, or to construct a form of scaffolding, which is both costly and time-consuming.

Accordingly, there is a need for a collapsible multi-surface, self-supporting ladder with an increased stability that does not require a second person or unnecessary assembly time. One aspect of the present disclosure is to provide a configuration that will help prevent injuries for an individuals who is climb, work on, dismount from, or do any other work with a ladder. It is contemplated that the exemplary embodiments disclosed below can be used on, inter alia, an extension ladder, pull-down attic ladder, one-piece straight ladder or any other ladder where additional stability is needed.

SUMMARY

According to one exemplary embodiment, the collapsible ladder assembly system includes a larger ladder section and a smaller strut section, wherein the smaller strut ends are pivotally connected to the larger ladder section at a point that is at or below the midpoint of the larger ladder section, therefore allowing the system to be collapsible. The larger ladder section and smaller strut section are further connected by a rigid adjustable linkage, or spreader, at points that are below the pivotable connection that are capable of adding further stability and maintaining a consistent predetermined angle or distance between the feet of the larger ladder and the smaller strut section.

According to another exemplary embodiment, the collapsible ladder assembly system includes a pre-existing larger ladder section and a smaller strut section, wherein the smaller strut ends are detachably and pivotally connected to the pre-existing larger ladder section at a point that is at or below the midpoint of the larger ladder section, therefore allowing the system to be collapsible and/or detachable. The larger ladder and smaller strut sections are connected by a rigid adjustable linkage, or spreader, at points that are below the pivotable connection. These linkage connections can be detachable at the pre-existing large ladder end and permanent at the smaller strut section, or a variation thereof.

The exemplary ladder configurations disclosed herein provide a means for stability on multiple surfaces. At the ground contacting point, the point where the rail or strut ends meet the ground, there are adjustable gripping feet or shoes, which can be independently or in combination vertically or angularly adjusted for maximum stability.

DESCRIPTION OF THE DRAWINGS

These and other advantages of the present invention will be readily understood with reference to the following specification and attached drawing wherein.

DETAILED DESCRIPTION

Figure 1:
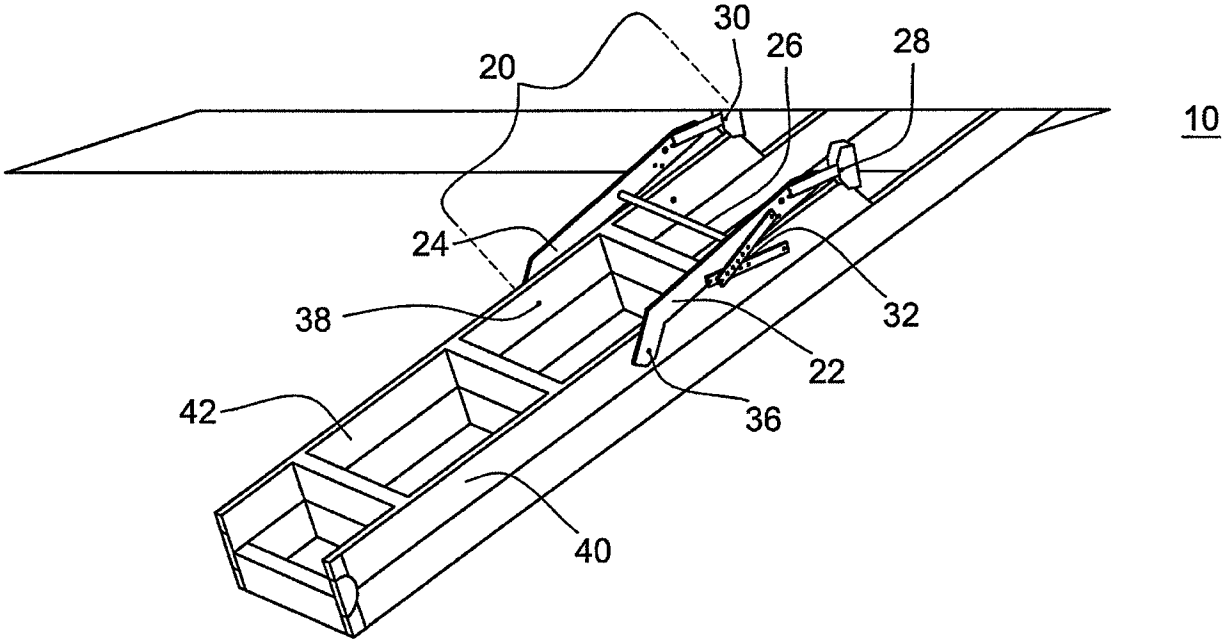
FIG. 1 is a front angular perspective view of a first embodiment of a ladder system of the present invention mounted on a pull-down ladder in the collapsed position.

Referring to FIG. 1, an embodiment of the ladder system 20 mounted to pull-down ladder 10 in a partially collapsed state is depicted. The ladder system 20, or smaller strut section, includes a pair of rails 22, 24 substantially identical but of opposite hand, a lateral cross member strut 26, a pair of adjustable feet 28, 30 substantially identical but of opposite hand, and a pair of rigid adjustable spreaders 32, 34 substantially identical but of opposite hand.

Figure 2:
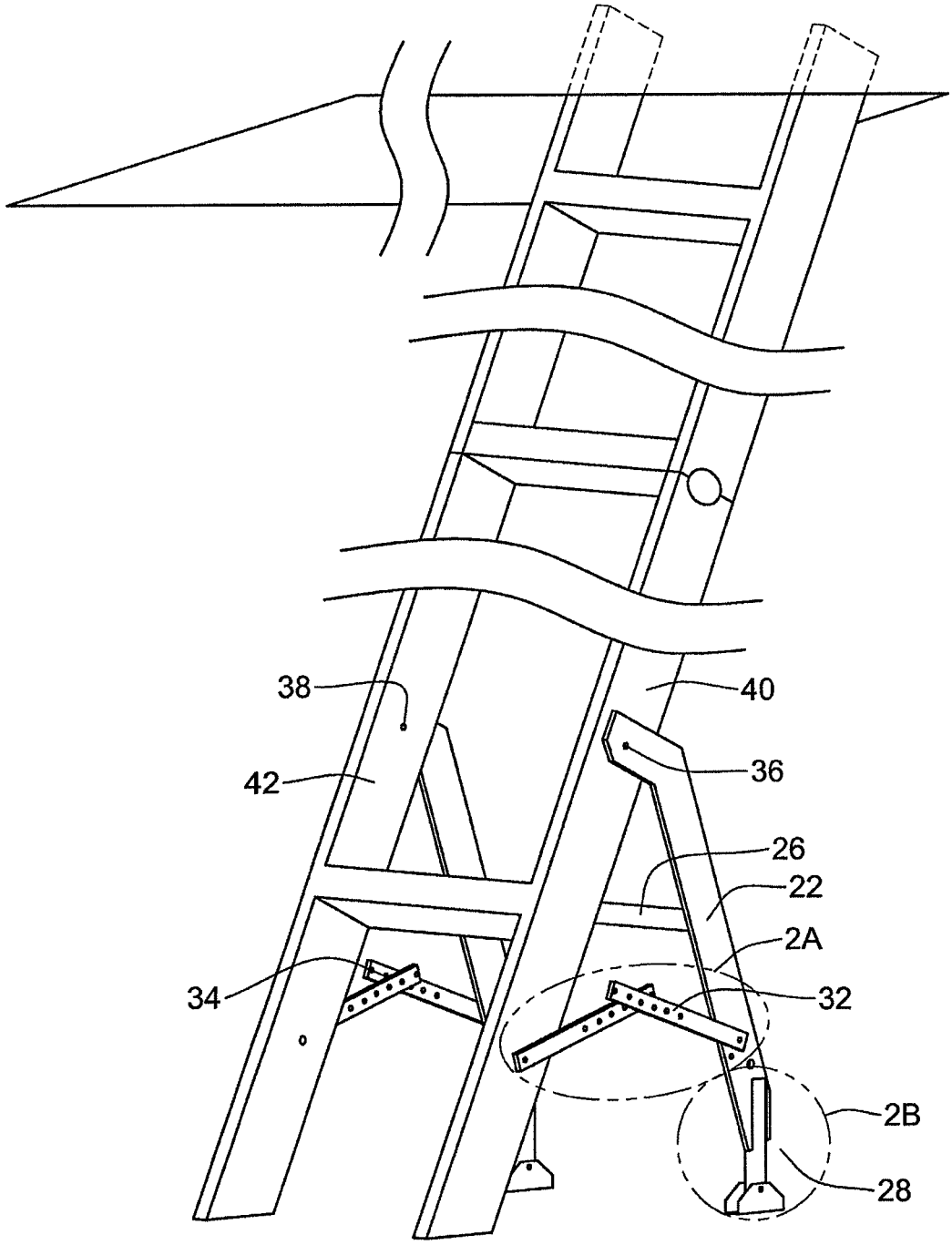
FIG. 2 is a front angular perspective view of the first embodiment of a ladder system of the present invention mounted on a pull-down attic ladder in the extended position.

Referring now to FIG. 2, the ladder system of FIG. 1 is shown fully extended. In this embodiment, the rails 22, 24 are substantially parallel, however in an alternative embodiment the rails 22, 24 may be outwardly flared at their lower ends to create a wider stance, allowing for increased stability. In either embodiment, each of the rails 22, 24 has a foot 28, 30 located at the end of the rail 22, 24 where contact is made with the ground, referred to as the ground contacting point, while the opposite end of each of the rail 22, 24 is pivotally connected, using pivotal connectors 36, 38, to its respective rails 40, 42 of the pull-down ladder 10. The pivotal connections 36, 38 can be either permanently connected by means of a bolt, rivet, pivoting hinge, etc., or alternatively, the pivotal connection can be removably attached to the rails 40, 42 of the pull-down ladder 10 by means of a clamping structure, allowing the ladder system to be used on a multitude of preexisting ladders.

Figure 2A:
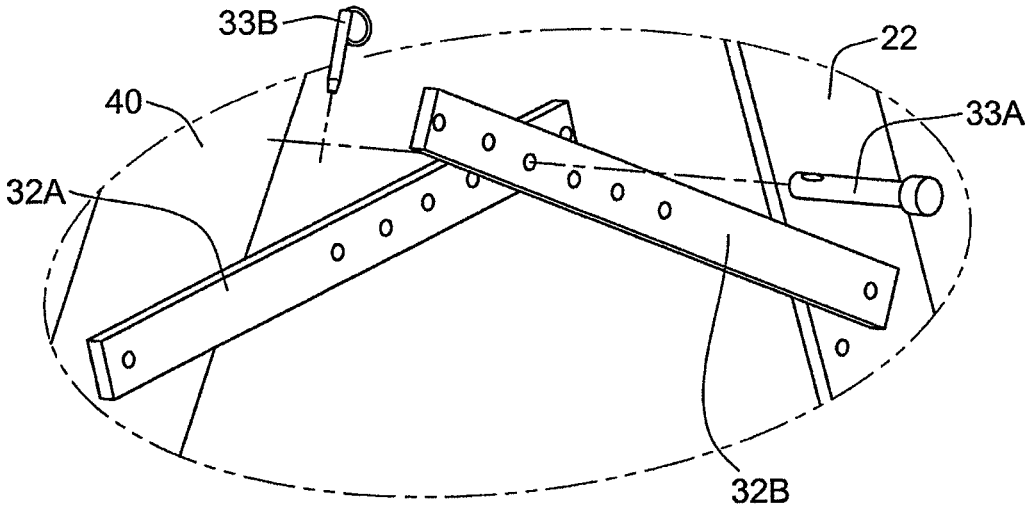
FIG. 2A is an exploded view of the adjustable spreader of the ladder system in FIG. 2.

Referring to FIG. 2A, an exploded view of an adjustable spreader of the ladder system, the depicted rigid adjustable spreader 32, 34 is generally composed of two rigid spans 32A, 32B that are pivotally connected at their ends with a shank 33*a* and lock pin 33*b* such that the two rigid spans 32A, 32B can lock in the fully extended position between the rails 22, 24 in the lower section, between the midpoint of the ladder rail length and the ground contact points, of their respective rails 40, 42 of the pull-down ladder 10. The pivotal connection is laterally adjustable such that the length of the spreader can be increased or decreased thereby increasing or decreasing the angle created between the ladder system rails 22, 24 and their respective rails 40, 42 of the pull-down ladder 10.

Figure 7:
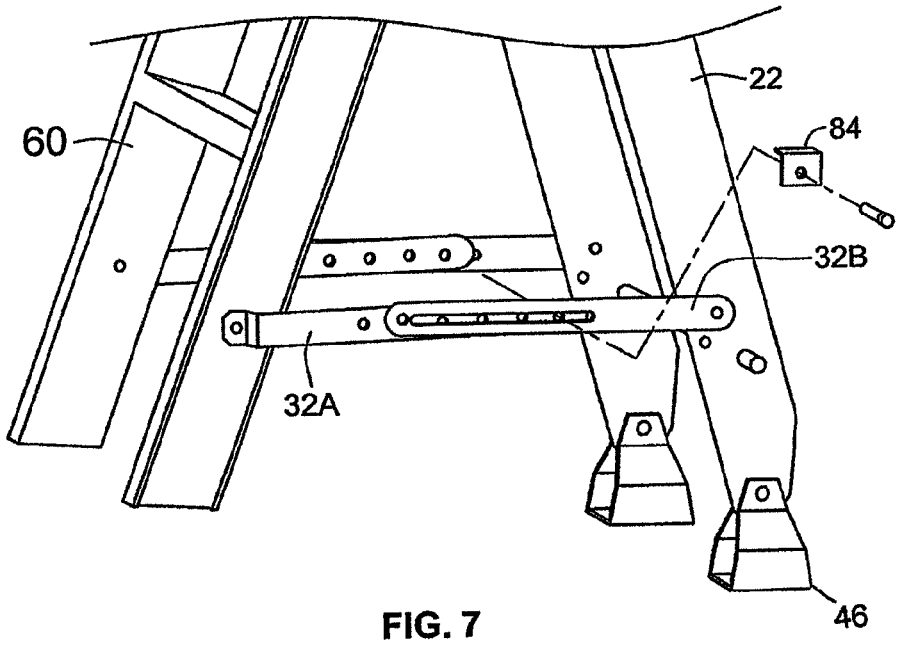
FIG. 7 is a side view of the ladder system showing the spreader in a locked extended position.

Referring to FIG. 7, another means for connecting two rigid spans 32A, 32B is shown. The two rigid spans 32A, 32B are connected to one another at two points with a permanent laterally slideable connection and a second connection that locks the span at the specified length using the safety stop 84 and a pin 33A that penetrates the hole of the safety stop 84 and the desired hole in the rigid span 32B therefore locking the overall length of the spreaders 32, 34. When the pin 33A is not in the safety stop 84, the spreader can be folded at the slideable connection. To prevent misplacement, the pin 33A may be tethered to the ladder or ladder system 20. In an alternative embodiment, there may be more than two rigid spans comprising the spreader, and the connection between the at least two rigid spans can be by another means, including, but not limited to, a threaded post and wing nut or screw caps 50.

Figure 2B:
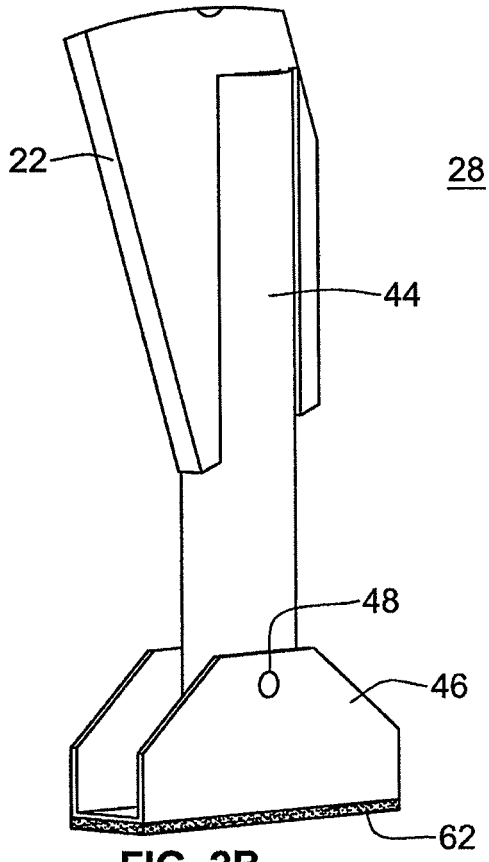
FIG. 2B is an exploded view of the adjustable foot of the ladder system in FIG. 2.

Referring to FIG. 2B, an exploded view of a ladder system foot 28 is shown. The feet 28, 30, located at the end of the rails 22, 24 at the ground contact point, are both angularly and vertically adjustable. Each of said feet 28, 30 is composed of two primary components, a vertically extendable shaft 44 and shoe 46 pivotally connected to the shaft 44 using a pivotal connector 48. The pivotal connector 48 allows the shoe 46 to conform to angle of the ground on which it is placed. If required, the pivotal connector 48 can be tightened, therefore locking the shoe 46 in the preferred arrangement.

Figure 9:
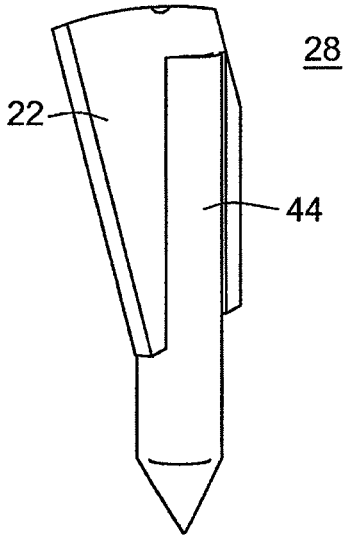
FIG. 9 shows an alternative foot where the shaft forms a spike.

The underside of the shoe 46 includes a gripping means 62 to minimize slippage at the ground contact point. Depending on the application, said gripping means 62 could be a rubber pad for use on a relatively smooth hard surface, spiked (as seen in FIG. 9) or staggered for use on grass and packed dirt, or even a planar foot that creates a large shoe surface area, therefore preventing the foot 28, 30 from sinking into soft ground. Depending on the choice of shoe 46, the ladder system 20 can be used on ground surfaces such as concrete, dirt, steel, tile, grating, brick, stone and most floor materials. The pivotable connector 48 between the shaft 44 and shoe 46 may be permanent or removable, therefore allowing one to interchange the shoe 46 depending on the application or environment.

Figure 8:
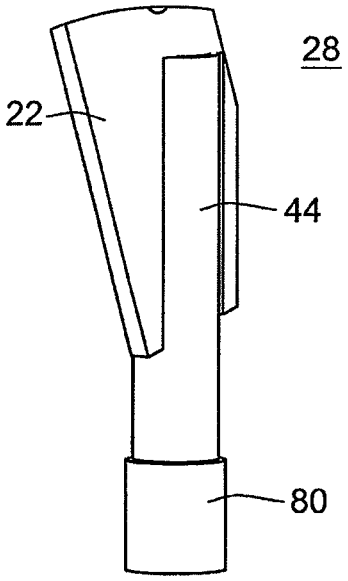
FIG. 8 shows an alternative foot with a rubber boot.

Alternative foot embodiments are shown in FIG. 7 wherein the shoe 46 is directly coupled to the end of the rails 22, 24 and FIG. 8 wherein the shaft 44 comes into direct contact with the ground or through an optional intermediate such as a rubber boot 80. The rubber boot 80 acts as a gripping means and prevents the shaft 44 from scratching the ground. Referring now to FIG. 9, in lieu of a rubber boot 80, the end of the shaft 44 may be pointed to increase ground penetration, therefore preventing slippage on dense penetratable surfaces such as dirt, grass, gravel and rock.

Figure 3A:
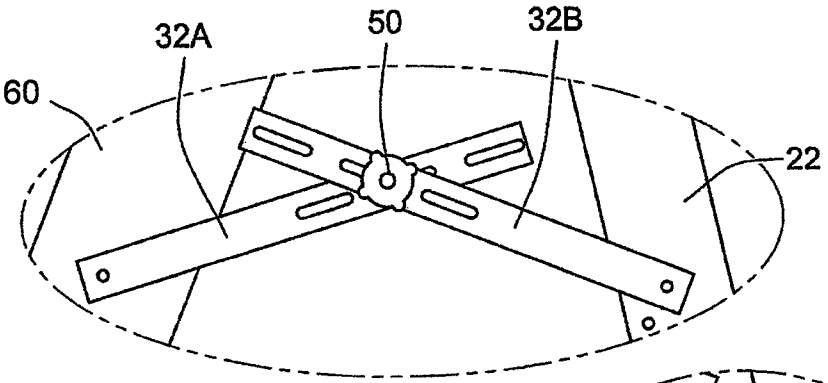
FIG. 3A is an exploded view of the adjustable spreader of the ladder system in FIG. 3.
Figure 3B:
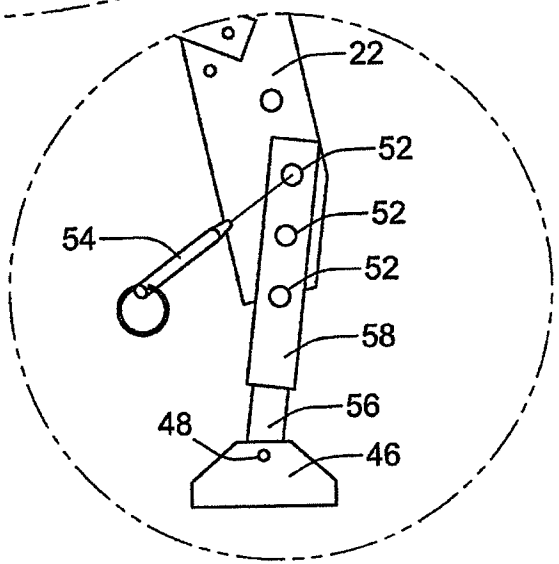
FIG. 3B is an exploded view of the adjustable foot of the ladder system in FIG. 3.
Figure 3:
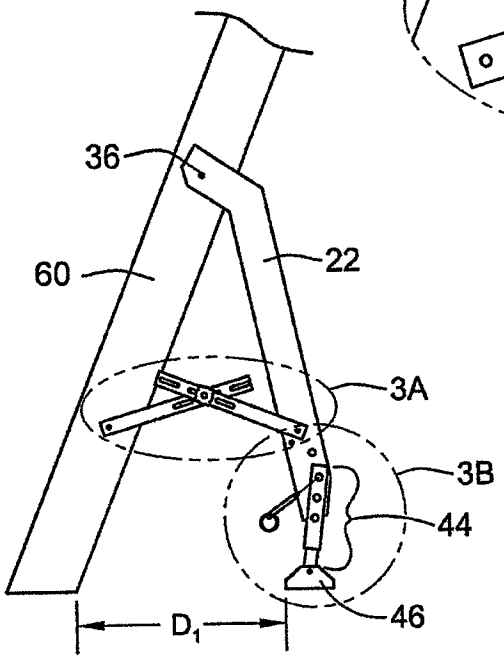
FIG. 3 is a side angular perspective view of a second embodiment of the adjustable ladder system of the present invention mounted on an extension ladder.
Figure 4A:
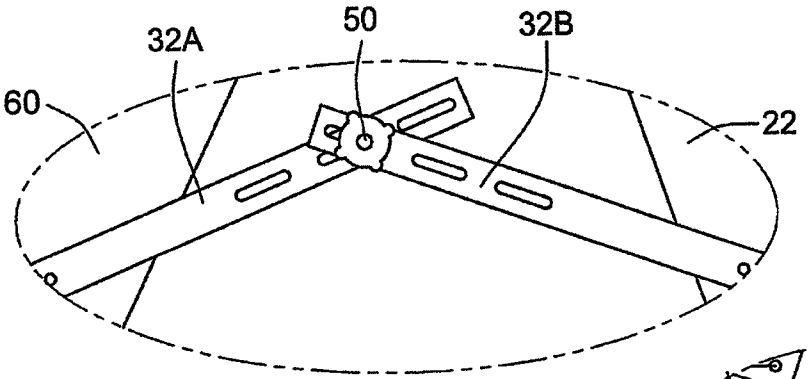
FIG. 4A is an exploded view of the adjustable spreader of the ladder system in FIG. 4.
Figure 4B:
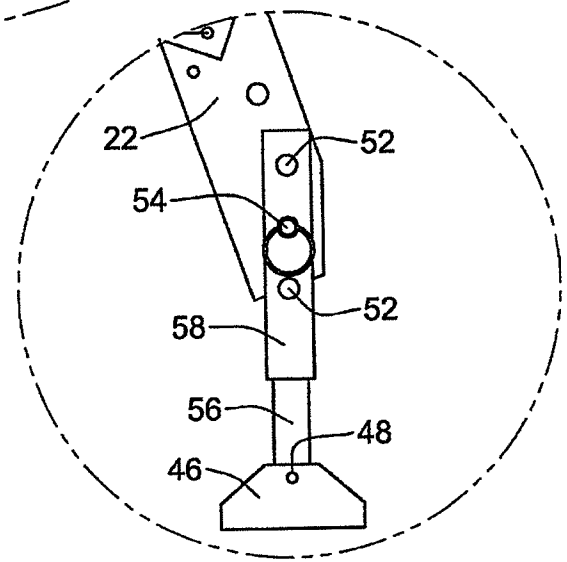
FIG. 4B is an exploded view of the adjustable foot of the ladder system in FIG. 4.
Figure 4:
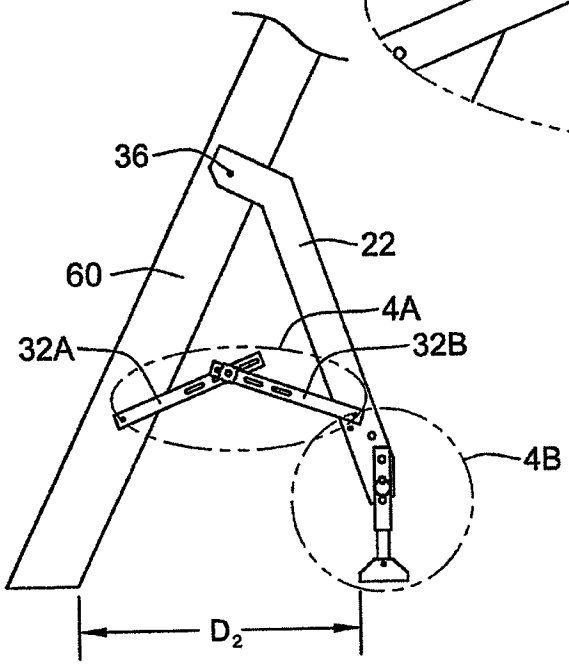
FIG. 4 is a side angular perspective view of a second embodiment of the adjustable ladder system of the present invention mounted on an extension ladder set up to allow for a greater ground footprint.
Figure 5A:
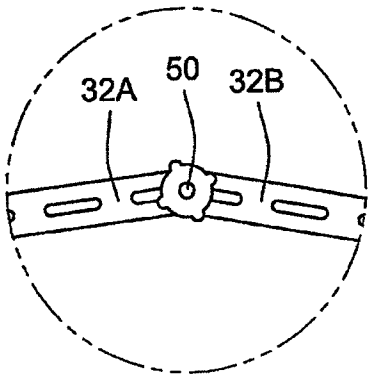
FIG. 5A is an exploded view of the fully extended adjustable spreader of the ladder system in FIG. 5.
Figure 5B:
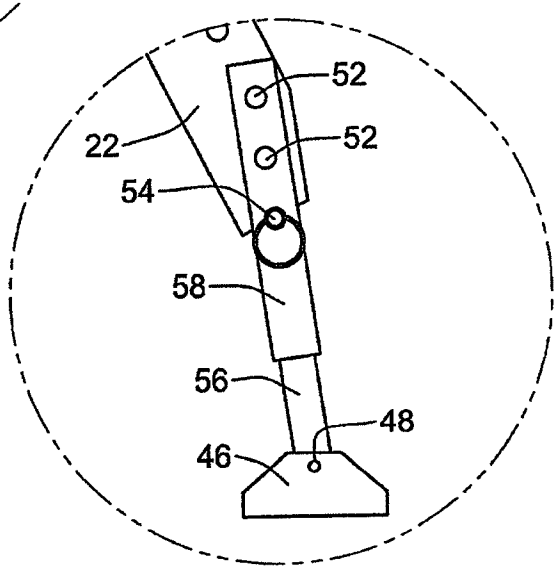
FIG. 5B is an exploded view of the adjustable foot of the ladder system in FIG. 5.
Figure 5:
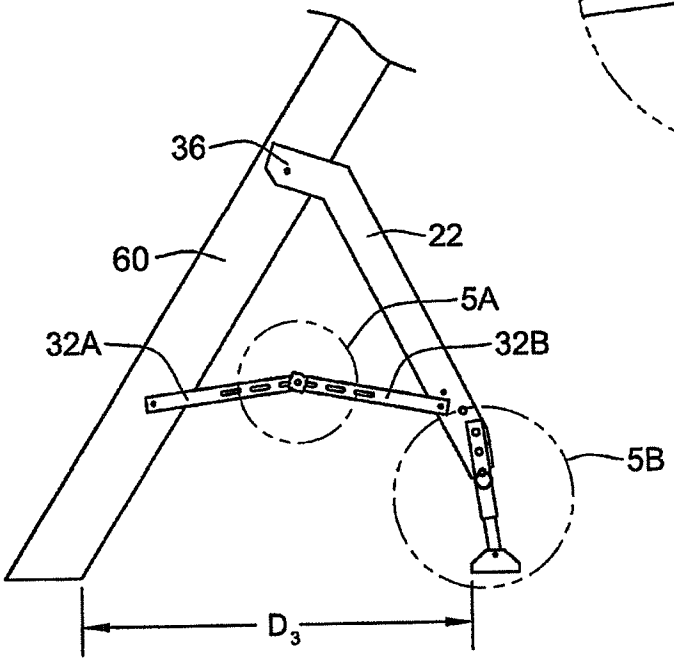
FIG. 5 is a side angular perspective view of a second embodiment of the adjustable ladder system of the present invention mounted on an extension ladder set up to allow for a maximum ground footprint.
Figure 6:
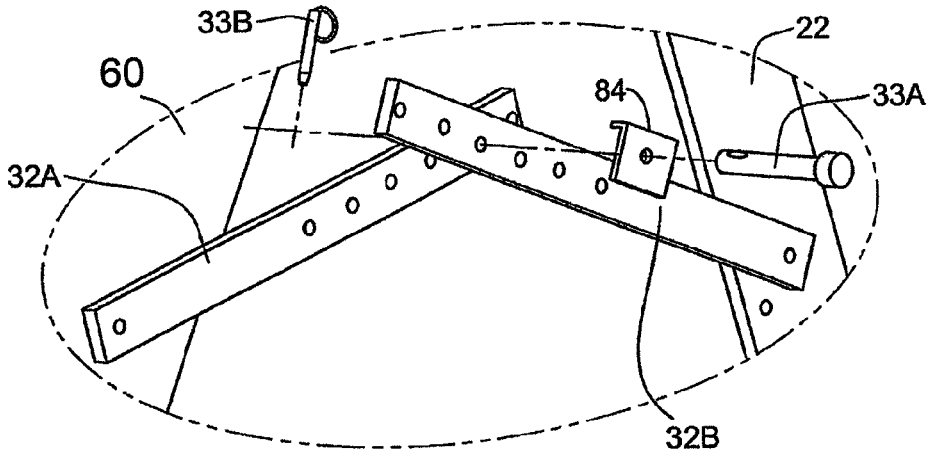
FIG. 6 is an exploded view of a partially extended adjustable spreader of the ladder system.

Referring now to FIGS. 3-5, in this embodiment, a side view of the ladder system's versatility is shown when the ladder system 20 is installed on a traditional straight ladder 60; however, the system is not restricted to a straight ladder but can be applied to any ladder where additional stability is required. FIGS. 3-5 show three adjustment configurations where the rigid adjustable spreaders 32, 34 have been laterally adjusted to create a larger overall footprint by increasing the distance between the larger ladder section 60 and the ladder system 20, the shaft 44 is vertically adjusted to ensure that steady contact between the shoe 46 and the ground is maintained, and the shoe 46 adapts to the angle and terrain of the ground. The shaft 44 as shown in FIGS. 3B, 4B and 5B is adjusted using two nested tubes 56, 58 with a plurality of holes 52 which, when adjusted to the appropriate height, can be aligned and locked into place using a set pin 54. In alternative embodiments, a push-button adjustment mechanism with or without a locking ring may be used to secure the two nested tubes 56, 58, the nested tubes 56, 58 may be locked at a specified length with a slip nut and washer, or the two nested tubes 56, 58 may be threadedly coupled wherein the overall shaft 44 is extended or shortened by rotating the shoe 46 and/or lower nested tube 56.

Figure 10:
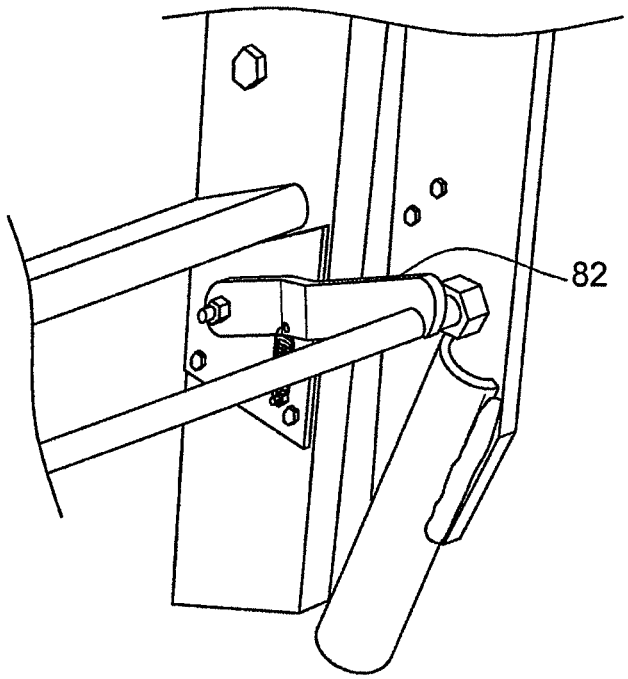
FIG. 10 shows the safety latch mechanism.

Referring to FIG. 10, the ladder system may be locked in the closed position using the safety latch 82, which locks the ladder system 20 to the ladder being stabilized. The safety latch can be used with a plurality of ladders, including but not limited to pull-down ladders, straight ladders and extension ladders. FIG. 10 shows the safety latch 82 attached to the lateral cross member strut 26, however in another embodiment, the safety latch 82 may attach to a loop or other latch receptacle.

The ladder system 20 structure as described can be constructed from any material known in the art of ladder fabrication, including but not limited to wood, metal, metal alloys, fiberglass, composites, carbon fiber, plastic or a combination thereof. Similarly, the rails of the smaller strut section, or ladder system 20 need not be the same material as the larger ladder section.

Obviously, many modifications and variations of the present invention are possible in light of the above teachings. Thus, it is to be understood that the invention may be practiced otherwise than as specifically described above.

What is claimed is:

1. An apparatus for stabilizing a ladder, the ladder having first and second substantially parallel side rails, each side rail having an inner surface, an outer surface defining a surface plane, a base end, an upper end, and at least two ladder rungs connecting the inner surface of the first substantially parallel side rail to the inner surface of the second substantially parallel side rail and disposed to lie generally perpendicular to said first and second substantially parallel side rails, the apparatus comprising:

(i) first and second substantially parallel support rails adapted for pivotal connection to said first and second substantially parallel side rails;

wherein each of said first and second substantially parallel support rails is a continuous length of material having a first end, a second end, and two substantially linear portions positioned therebetween;

wherein said two substantially linear portions are positioned in substantially the same plane at an obtuse angle relative to one another to form each of said first and second substantially parallel support rails;

wherein the side rail's length is at least double that of the support rail's length;

(ii) one or more longitudinal cross members disposed between said first and second substantially parallel support rails;

(iii) one or more pivotable connectors for adjoining the first end of the first substantially parallel support rail to the outer surface of the first substantially parallel side rail at a point between the base end and the midpoint of said substantially parallel side rail's length and the first end of the second substantially parallel support rail to the outer surface of the second substantially parallel side rail at a point between the base end and the midpoint of the substantially parallel side rail's length;

wherein said first substantially parallel support rail selectively extends from the base end of the first substantially parallel side rail, said first substantially parallel support rail selectively extending in a plane that is substantially parallel to the first substantially parallel side rail's surface plane;

wherein said second substantially parallel support rail selectively extends from the base end of the second substantially parallel side rail, said second substantially parallel support rail selectively extending in a plane that is substantially parallel to the second substantially parallel side rail's surface plane;

(iv) one or more rigid adjustable spreaders for connecting each of said first and second substantially parallel support rails to a substantially parallel side rail at a point between the base end and the support rail's pivotal connection point, wherein the adjustable spreader is adjustable in length and is configured to fold at a point approximately half way between the adjustable spreader's distal ends; and (v) a shoe located at each ground contact point.

2. The apparatus of claim 1, wherein said shoe is adjustable.

3. The apparatus of claim 1, wherein said shoe has a gripping means to prevent slippage at the ground contact point.

4. The apparatus of claim 1, wherein the primary material is a metal or metal alloy.

5. The apparatus as in claim 1 wherein the primary material is a fiberglass or a composite.

6. The apparatus as in claim 1 wherein the primary material is a wood or wood composite.

7. The apparatus of claim 1, wherein each support rail is formed from a single unbroken piece of material.

8. A ladder apparatus, comprising:

(i) first and second substantially parallel side rails, each side rail having an inner surface, an outer surface defining a surface plane, a base end, an upper end and at least two ladder rungs connecting the inner surface of the first side rail to the inner surface of the second side rail and disposed to lie generally perpendicular to said first and second substantially parallel side rails;

(ii) first and second substantially parallel support rails adapted for pivotal connection to said first and second substantially parallel side rails;

wherein each support rail is a continuous length of material having a first end, a second end, and two substantially linear portions positioned therebetween;

wherein said two substantially linear portions are positioned in substantially the same plane at an obtuse angle relative to one another to form each of said first and second substantially parallel support rails;

wherein the side rail's length is at least double that of the support rail's length;

(iii) one or more longitudinal cross members disposed between said first and second substantially parallel support rails;

(iv) one or more pivotable connectors for adjoining the first end of the first substantially parallel support rail to the outer surface of the first substantially side rail at a point between the base end and the midpoint of said substantially parallel side rail's length and the first end of the second substantially parallel support rail to the outer surface of the second substantially parallel side rail at a point between the base end and the midpoint of the substantially parallel side rail's length;

wherein said first substantially parallel support rail selectively extends from the base end of the first substantially parallel side rail, said first substantially parallel support rail selectively extending in a plane that is substantially parallel to the first substantially parallel side rail's surface plane;

wherein said second substantially parallel support rail selectively extends from the base end of the second substantially parallel side rail, said second substantially parallel support rail selectively extending in a plane that is substantially parallel to the second substantially parallel side rail's surface plane;

(v) one or more rigid adjustable spreaders for connecting each of said first and second substantially parallel support rails to a substantially parallel side rail at a point between the base end and the support rail's pivotal connection point, wherein the adjustable spreader is adjustable in length and is configured to fold at a point approximately half way between the adjustable spreader's distal ends; and (vi) a shoe at each ground contact point.

9. The apparatus of claim 8, wherein said shoe is adjustable.

10. The apparatus of claim 8, wherein said shoe has a gripping means to prevent slippage at the ground contact point.

11. The apparatus of claim 8, wherein the primary material is a metal or metal alloy.

12. The apparatus as in claim 8 wherein the primary material is a fiberglass or a composite.

13. The apparatus as in claim 8 wherein the primary material is a wood or wood composite.

14. The apparatus of claim 8, wherein each support rail is formed from a single unbroken piece of material.

15. A ladder system for stabilizing a ladder, the ladder having first and second substantially parallel side rails, each side rail having an inner surface, an outer surface defining a surface plane, a base end, an upper end, and at least two ladder rungs connecting the inner surface of the first substantially parallel side rail to the inner surface of the second substantially parallel side rail and disposed to lie generally perpendicular to said first and second substantially parallel side rails, the ladder system comprising:

(i) first and second substantially parallel support rails adapted for pivotal connection to said first and second substantially parallel side rails;

wherein each of said first and second substantially parallel support rails is a continuous length of material having a first end, a second end, and two substantially linear portions positioned therebetween;

wherein said two substantially linear portions are positioned in substantially the same plane at an obtuse angle relative to one another to form each of said first and second substantially parallel support rails;

wherein the side rail's length is at least double that of the support rail's length;

(ii) one or more cross members disposed between said substantially parallel support rails;

(iii) one or more pivotable connectors for adjoining the first end of the first substantially parallel support rail to the outer surface of the first substantially parallel side rail at a point between the base end and the midpoint of said substantially parallel side rail's length and the first end of the second substantially parallel support rail to the outer surface of the second side rail at a point between the base end and the midpoint of the substantially parallel side rail's length;

wherein said first substantially parallel support rail selectively extends from the base end of the first substantially parallel rail, said first substantially parallel support rail selectively extending in a plane that is substantially parallel to the first substantially parallel side rail's surface plane;

wherein said second substantially parallel support rail selectively extends from the base end of the second substantially parallel rail, said second substantially parallel support rail selectively extending in a plane that is substantially parallel to the second substantially parallel side rail's surface plane;

(iv) one or more rigid spreaders for connecting each of said first and second substantially parallel support rails to a substantially parallel side rail at a point between the base end and the support rail's pivotal connection point, wherein the spreader is adjustable in length and is configured to fold at a point approximately half way between the adjustable spreader's distal ends; and (v) a vertically extendable shaft at each support rail's second end, wherein the vertically extendable shaft includes a shoe at each ground contact point.

16. The system of claim 15, wherein said shoe is adjustable.

17. The system of claim 15, wherein said shoe has a gripping means to prevent slippage at the ground contact point.

18. The system of claim 15, wherein the primary material is a metal or metal alloy.

19. The system of claim 15, wherein each support rail is formed from a single unbroken piece of material.

* * * * *